United States Patent [19]

Hochbein

[11] Patent Number: 5,048,811

[45] Date of Patent: Sep. 17, 1991

[54] SINGLE HEAD DEVICE FOR REMOVING ALTERNATE ARTICLES FROM A STACK OF THE ARTICLES

[75] Inventor: David E. Hochbein, Sarver, Pa.

[73] Assignee: Aluminum Company of America, Pittsburgh, Pa.

[21] Appl. No.: 386,622

[22] Filed: Jul. 31, 1989

[51] Int. Cl.[5] ..... B65H 5/22

[52] U.S. Cl. ..... 271/5; 271/11; 271/20; 271/104; 271/106; 271/194; 271/300; 294/64.1

[58] Field of Search ..... 271/19-20, 271/90, 104-106, 107, 5, 11, 194, 300; 414/797, 789.5; 294/64.1, 65

[56] References Cited

U.S. PATENT DOCUMENTS

| | | | |
|---|---|---|---|
| 3,693,321 | 9/1972 | Nilsson | 414/797 X |
| 4,067,458 | 1/1978 | Schneider et al. | 414/797 X |
| 4,185,814 | 1/1980 | Buchmann et al. | 271/259 X |

FOREIGN PATENT DOCUMENTS

| | | | |
|---|---|---|---|
| 1122893 | 10/1962 | Fed. Rep. of Germany | 414/797 |
| 252543 | 12/1985 | Japan | 271/106 |
| 0209734 | 9/1986 | Japan | 414/797 |

OTHER PUBLICATIONS

Masera, L. A., "Adjustable Vacuum-Type Pickup Head for Handling Substrates", 9-1984, AT&T Tech. Digest, No. 75, pp. 31, 32.

*Primary Examiner*—Robert P. Olszewski
*Assistant Examiner*—Boris Milef
*Attorney, Agent, or Firm*—Elroy Strickland

[57] ABSTRACT

A method and apparatus for removing the uppermost article from a stack of alternating first and second articles. The apparatus includes a plurality of pins and a plurality of suction devices, the pins and suction devices being supported from the lower side of a support structure. The support structure, with the suction devices and pins, comprise a head or end effector for sequentially removing the alternating articles from the stack. Means are provided for moving the head from the stack to two respective locations for receiving the first and second articles in respective piles of the articles. The stack of alternating articles, and the respective piles of the articles after they are removed from the stack, are preferably held in an inclined cassette that aligns the articles and maintains the articles in alignment.

2 Claims, 2 Drawing Sheets

SINGLE HEAD DEVICE FOR REMOVING ALTERNATE ARTICLES FROM A STACK OF THE ARTICLES

BACKGROUND OF THE INVENTION

Figure 1:
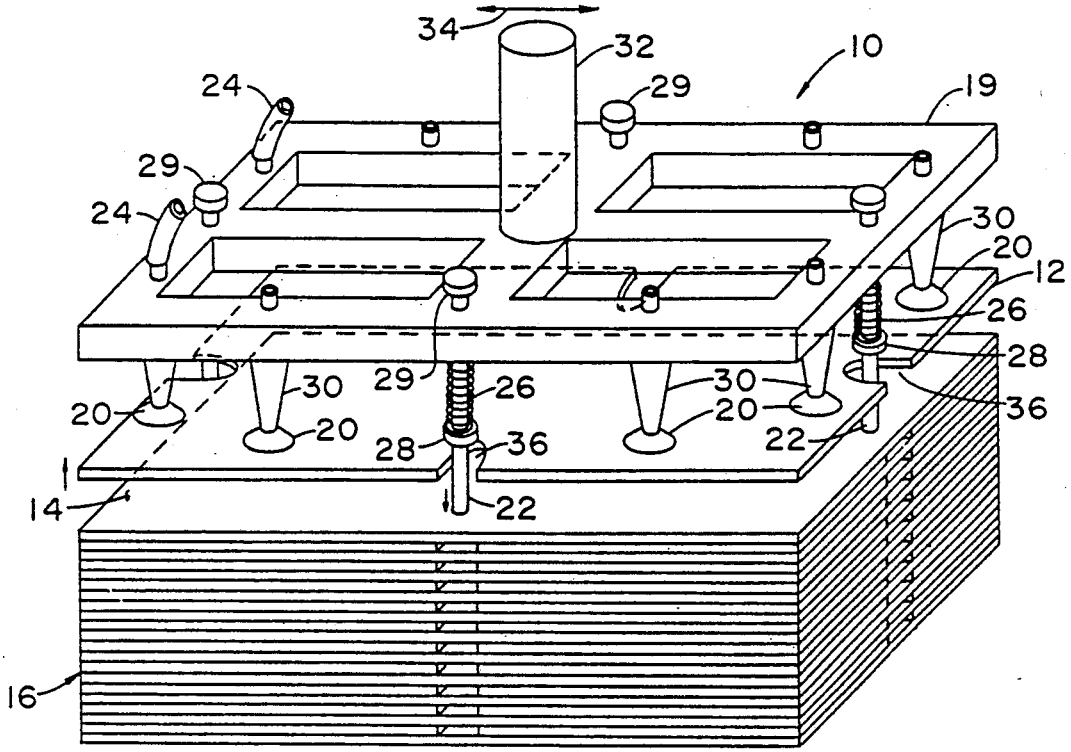

The present invention relates generally to the vacuum removal of articles from a vertical stack of the articles, or at some angle to the vertical, and particularly to a single unit device that consecutively and sequentially removes interleaved, alternating first and second articles from a stack of the articles. The invention has particular utility in separating green ceramic cards from sheets of paper employed to separate the cards from each other, though the invention is not limited thereto.

Green ceramic cards are used in a co-fired multi-layer process to manufacture interconnect devices for integrated circuit chips. In making such devices, several layers of the green cards are placed together, aligned, laminated, and then cut into small squares or rectangular shapes, each shape providing a substrate package and carrier for an integrated chip after the carrier is fired and cured.

In processing the cards, the cards are preferably stacked with interleaved sheets of paper to prevent the transfer of any substance from one card, such as metallization, to an adjacent card. Further, if the cards and paper are stacked in an inclined container, the paper has smooth surfaces that assist the cards, which are abrasive, to slide into the lowermost position in the container, thereby aligning the cards and paper in the container. Before the cards can be used in making the interconnects discussed above, the paper sheets and cards must be separated from each other.

Green ceramic cards are also fragile and abrasive, the material of the cards being easily broken and torn. Manual handling and separation of the paper sheets and cards without tearing the cards is difficult, and personnel handling the cards must wear gloves. Gloves are also required to prevent fingerprints in locations where metallization of the card (substrate) surface occurs in the process of providing the card with circuit leads.

SUMMARY OF THE INVENTION

It is therefore an objective of the invention to automatically separate fragile, flexible, interleaved articles such as a stack of green ceramic cards and paper separators, and depositing the same at separate locations without tearing the cards. The papers can be deposited in a stack or pile of the same while the cards can be "singulated" for further downstream processing.

Because of the demand for automated handling in the manufacture of integrated circuit devices, the above separation of cards and paper should be effected at high speed and without simultaneously lifting the next paper or ceramic card in the stack. A typical removal rate cycle for one card in the present invention is five seconds.

A further objective of the invention is to use plain sheets of paper as separators, without any slots or holes provided in the sheets, or any other feature that would add to the cost of the sheets and therefore to the cost of the overall process.

These and other objectives are met by use of a single head or end effector device provided with a plurality of suction cups and spring loaded hold-down pins that engage the uppermost card or paper sheet of a vertical stack of the cards and sheets. The head removes the cards and sheets sequentially, i.e., first one and then the other, from the stack and deposits them at respective locations.

A number of U.S. patents have issued showing the use of vacuum cups to lift sheets of material from a vertical stack, with parallel, adjacent fingers for holding down a portion of the uppermost sheet to effect an initial separation of the uppermost sheet from the next sheet. Adjacent sheets of material are often held together by static electricity, and, in addition, when the lifting force created by vacuum and suction occurs, the force of the suction will penetrate the uppermost sheet and attract the next adjacent sheet, thereby simultaneously lifting both sheets to the vacuum device.

A U.S. patent representative of this art is U.S. Pat. No. 3,826,485 to Shindo. Shindo employs two suction devices individually vertically translatable in combination with an intermediate holddown pin. Initially, one of the suction devices engages the uppermost sheet near one edge of a stack of sheets, the suction device being activated to lift the edge of the uppermost sheet. This allows air to enter between the uppermost and next adjacent sheet to break initial attraction between the two sheets. A second suction device engaging the sheet is next lifted, with the hold-down pin, to complete removal of the sheet from the stack.

The sheets of material that the device of Shindo lift and transport are homogeneous such that each lifting operation is the same, the lifting head and mechanism always "seeing" the same type of sheet.

A lifting head structure employed to separate green ceramic sheets and interleaved paper separators is shown in U.S. Pat. No. 4,185,814 to Buchmann et al. Here a box-like structure is provided with a peripheral, vacuum creating lip. The lip is employed to engage the periphery of an uncured green ceramic sheet or paper separator. A vacuum is also created in the center of the box such that the sheet or paper separator functions as a diaphragm across the width of the box. Such a head requires that it be able to determine which of the items (ceramic sheet or paper separator) the head is engaging. To this end, separate ceramic and paper sheet sensor pins are provided at spaced apart locations on the head, and the ceramic sheets and paper separators provided with holes corresponding to the locations of the two sensor pins. The head does not provide means to maintain the uppermost paper sheet in contact with the next ceramic sheet so that the paper can be partially lifted, and to holddown the paper sheet when the uppermost item is a ceramic card.

THE DRAWINGS

Figure 2:
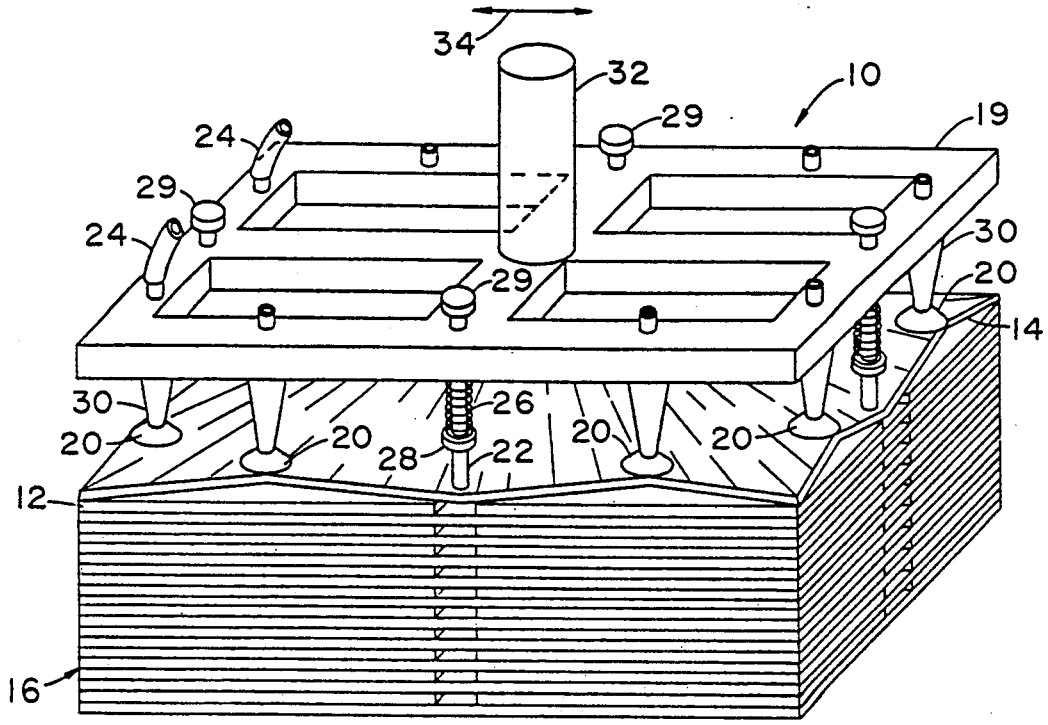
Figure 3:
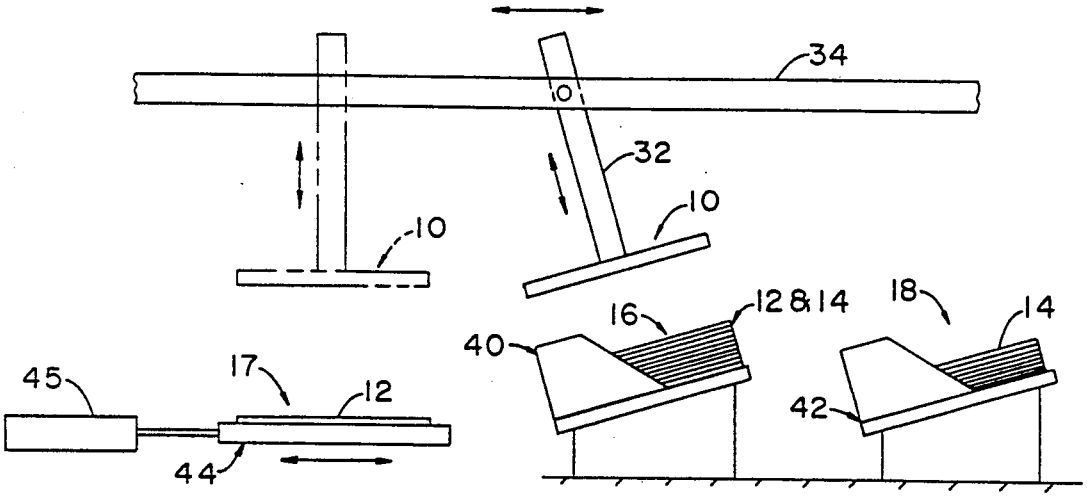

The objectives and advantages of the invention will be better understood from consideration of the following detailed description and the accompanying drawings in which:

FIG. 1 is a perspective and somewhat diagrammatic view of the single head structure of the invention shown in the process of separating a slotted item such as a green ceramic card from a next adjacent item, such as a paper separator, all located in a somewhat vertical stack of the items, FIG. 2 is the head structure of FIG. 1 shown separating the uppermost nonslotted sheet from a next adjacent slotted sheet in a somewhat vertical stack of the sheets, and FIG. 3 shows two locations for receiving the alternate items of FIGS. 1 and 2 transported from a single cassette located between the two locations.

PREFERRED EMBODIMENTS

Referring now to the figures of the drawings, a single end effector assembly 10, hereinafter referred to as a "head" or "lifting head", is shown somewhat schematically for separating two different alternate items 12 and 14 of flexible material by removing them from a stack 16 of the items and for transporting them to separate respective locations 17 and 18 (FIG. 3) of the alternate items. The head is particularly suitable for lifting and separating flexible, fragile blanks or cards from paper sheets separating the blanks or cards.

Head 10 includes a rigid plate 19 that supports a plurality of suction cups 20 and a plurality of spring-loaded, translatable pins 22. Portions of the plate can be removed (as shown) to decrease its mass and thereby increase its ability to be moved in a rapid manner.

Hoses 24, only partially shown in FIGS. 1 and 2, connect suction cups 20 to a source of vacuum or suction (not shown). Coil springs 26 are shown disposed on the shanks of pins 22 and located between the lower surface of plate 19 and shoulder means 28 provided on the shanks at a location between the plate and the end of each pin. The vertical location of each shoulder is such that the lower end of the pins can extend below uppermost sheet 12 of stack 16 to the next adjacent sheet 14 in the manner shown in FIG. 1. The upper end of each pin 22 is provided with a shoulder or cap 29 to retain the pin in plate 19.

Cups 20 are connected to the hoses and are supported on the underside of plate 19 by respective hollow connectors 30 suitably mounted in or to the plate.

The head assembly, as thus far described, is secured to the end of a shaft or post 32, that, in turn, is suitably mounted on overhead, horizontal conveying means, diagrammatically represented by horizontal line 34 in FIG. 1 and 2. Shaft 32 is vertically translatable by a suitable actuator (not shown) so that head 10 can be raised to a first, rest position over stack 16 and lowered to a second, pick-up position over the stack. In FIG. 1 of the drawing, head 10 is shown in the second position over stack 16.

The edges of the uppermost item 12 in stack 16 in FIG. 1 which are provided with slots 36. The slots are aligned with each other when properly stacked, and respectively aligned with the axes of pins 22 when head 10 is located over and aligned with stack 16. When head 10 is lowered to its second position over the stack of FIG. 1, the pins travel through slots 36 in uppermost item 12 to engage the next adjacent item 14. In the case of a stack of green ceramic cards separated by sheets of paper, uppermost item 12 is such a card; the second item 14 is the separating paper.

The lateral locations of cups 20 on plate 19 are such that they engage the periphery of the uppermost item in stack 16 when the head is lowered to its second position. The vertical level of all cups is the same such that they evenly engage the uppermost item 12 having slots 36. When suction is effected through the cups, and the head is lifted, the cups evenly lift the edges of 12 so that 12 will not wrinkle and/or tear.

In the lowered, second position, head 10 is ready to lift the uppermost item 12 in stack 16. At least a partial vacuum is drawn through cups 20, via connectors 30 and connecting hoses 24, to provide a lifting force to the edges of item 12. The edges lift first, thereby allowing air to enter between the edges of the uppermost and next adjacent item 14. The flow of such air assists the separating process before the uppermost item fully separates from the next item.

In the separating process, the item 12 is drawn to cups 20, as shown in FIG. 1, while the springs 26 of pins 22 maintain the pins in engagement with the upper surface of the next item 14. In this manner, any remaining electrostatic or other attraction between 12 and 14 is overcome by the force of pins bearing against item 14 and acting against the lifting force exerted when head 10 is lifted. Item 12 is thereby available to be removed from stack 16 and transferred to a location 17 (FIG. 3) by head 10 and horizontal conveying means 34. The head is raised by its actuator, operating on shaft or post 32, taking with it uppermost item 12. Horizontal conveying means then laterally translates the head to the location of 17 or 18 chosen for receiving items 12. Item 12 is released to its chosen location by removing the vacuum or suction from cups 20.

With uppermost item 12 removed from stack 16, a non-slotted, flexible item 14 such as a paper separator, is now the uppermost item in the stack. This is shown in FIG. 2 of the drawing. Horizontal conveying means 34 returns and aligns head 10 to a first position over stack 16, and the actuator of shaft 32 lowers the head to the second, pick-up position over the stack. The head is now ready to remove the uppermost item 14 from the stack.

This is accomplished by pins 22 holding uppermost item 14 against the next, slotted item 12, at the locations of the pins, as the suction effected through cups 20 pulls those edge portions of separator 14 immediately below the cups to the cups. This is seen in FIG. 2, in which the pins pucker edge portions of 14 at the locations of the pins, and thereby allow air to enter between 14 and 12. This begins the process of separating the sheet from the card. As head 10 is raised by post 32, the pins will travel to their full extent by action of springs 26 to holddown item 14 before the pins raise with the head. Because of the action of springs 26 on the pins, the pins, in combination with the suction cups, maintain the pucker in item 14 so that air continues to flow and travel from four sides towards the central area between the uppermost and next adjacent item in stack 16 to overcome any remaining attraction between the two items.

After the head is raised, with paper separator 14 attached to cups 20, it is laterally translated by mechanism 34 to location 18 that has been chosen for collecting the paper separators. The vacuum effected through cups 20 is removed, and the separator falls to the collection (pile) of items 14.

The above sequence of operations is repeated for rapid effective separation and removal of items 12 and 14 of stack 16 until removal of the entire stack is completed. This sequence of operation is preferably effected by the commands of suitable computer (not shown) connected and programmed to control the actuator of post 32, conveyor 34 and the source of vacuum that creates the suction for cups 20.

The head 10 of the invention can function in a perfectly vertical manner, as shown in FIGS. 1 and 2 of the drawings, or in an inclined manner, as shown in FIG. 3. Inclined cassettes or holders 40 and 42 are preferable in the present invention because of their ability to align stacks of items, using the force of gravity acting upon the incline. This is particularly suitable for stacking alternating green ceramic cards and paper separators, as shown diagrammatically by stack 16 in FIG. 3. The use of paper separators are advantageous in separating the cards from the separators, as the separators serve well the holddown function described above in connection with FIG. 2. Paper separators are also useful, as explained earlier, in preventing the transfer of any metallization on the surface of one card to that of the next adjacent card. In using inclined cassettes, the paper also assists in aligning the paper and cards, as the cards slide easily to the lower side of the cassette and lodge in the lower corners of the cassette.

Hence, in FIG. 3, center stack 16 is contained in a cassette 40. Lifting head 10 is inclined in the same manner as the cassette so that it can function to separate and relocate the cards and papers, as described above. In addition, in FIG. 3, each of the cards 12 is transported to and disposed on carrier means 44, located to the left of center stack 16 and in a horizontal plane, while paper separators 14 are transported to and collected in pile 18 in inclined cassette 42, located to the right of center stack 16. The above computer orders the operation of the actuators for head 10 and conveyor 34 to alternately stack the papers in cassette 42 and dispose each card on 44 in the manner described above. Carrier 44 receives each card and is singularly moved by cylinder 45 to a station (not shown) for further processing of the card. This occurs while each paper item 14 is being transported to cassette 42. Hence, when head 10 returns to 44, 44 will be empty and ready to receive the next card.

Since carrier 44 is located in a horizontal plane, it is preferable that head 10 release item 12 in a vertical manner, as opposed to the inclined manner of releasing item 14. To this end, post 32 can be suitably articulated to a vertical position, as shown in phantom in FIG. 3, when it is translated to the left to carry item 12 to carrier 44. When the head is returned to center cassette 40, it is returned to its inclined position.

With head 10 of the invention, a single end effector is employed to consecutively alternately remove both slotted items 12 and non-slotted items 14 from a single stack of the items. The head does this rapidly and without tearing the items. In the case where the stack consists of homogeneous items, head 10 can also be used to sequentially remove items from the stack, i.e., if the stack is composed of unslotted paper sheets capable of being puckered by pins 22 and cups 20, head 10 can remove such sheets in a rapid, one-by-one fashion.

While the invention has been described in terms of preferred embodiments, the claims appended hereto are intended to encompass all embodiments which fall within the spirit of the invention.

What is claimed is:

1. Apparatus for sequential removal of planar green ceramic sheets and paper sheets separating the ceramic sheets from a stack of the ceramic and separating sheets, said ceramic sheets having notches extending inwardly from their edges, with all of said sheets being of the same size and aligned such that the edges of the paper sheets extend across the open areas of the notches in the ceramic sheets, the apparatus comprising:

a plurality of suction devices for engaging the uppermost sheet of said stack of sheets at spaced apart locations adjacent the edges of the uppermost sheet, a plurality of pins located between the suction devices, and means providing unitary support of the suction devices and pins, said pins being located to pass through the notches in the uppermost sheet when the uppermost sheet is a green ceramic sheet, and extend to the next paper sheet in said stack when the suction devices and pins are lowered from a rest position to a pick-up position, said pins being effective to hold the paper sheet in place beneath the notches of the uppermost ceramic sheet while the suction devices raise the uppermost ceramic sheet in a planar condition without bending the same from the paper sheet and stack when at least a partial vacuum is drawn through the suction devices, said suction devices in addition being effective to pucker portions of the uppermost paper sheet at locations immediately beneath the suction devices when a paper sheet is the uppermost sheet in the stack while said pins hold portions of the paper sheet intermediate of the suction devices against the next uppermost ceramic sheet when a vacuum is drawn through the suction devices.

2. A method of removing the uppermost item from a stack of thin, planar, flexible, alternating green ceramic cards and interleaved paper sheets separating said cards, said method comprising:

providing a stack of alternating green ceramic cards and sheets of paper, moving means that supports a plurality of pins and a plurality of individual suction cups from a first rest position to a second pick-up position above said stack, said plurality of suction cups extending from a lower side of said support means and spaced apart at distances sufficient to lift the uppermost article from the stack when a lifting force is supplied to said cups, said plurality of pins also extending from the lower side of said support means and located between said suction cups, applying a lifting force to the plurality of suction cups when said support means is in said second position, and while said plurality of pins engage a paper sheet that is the uppermost item in said stack without penetrating the paper sheet, said lifting force being effective to lift and pucker portions of said uppermost sheet while said pins hold portions of the sheet between said suction cups and adjacent the edges of sheet against the next uppermost ceramic card, moving said support means and paper sheet from said second position to a drop location, releasing said lifting force from said cups when said support means is at said drop location.

returning said support means to the pickup position, applying a lifting force to the plurality of suction cups while the pins extend through slots provided in the edges of the uppermost ceramic card and engage the edges of the next paper sheet, lifting the ceramic card without bending the same, moving said support means and card from the second position to a second drop location, and releasing said lifting force when the support means is at said second drop location.

* * * * *